US005506495A

United States Patent [19]

Uchida

[11] Patent Number: 5,506,495

[45] Date of Patent: Apr. 9, 1996

[54] STEP-DOWN CIRCUIT WITH STABILIZED INTERNAL POWER-SUPPLY

[75] Inventor: Toshiya Uchida, Kawasaki, Japan

[73] Assignee: Fujitsu Limited, Kawasaki, Japan

[21] Appl. No.: 213,747

[22] Filed: Mar. 16, 1994

[30] Foreign Application Priority Data

Jul. 12, 1993 [JP] Japan ..... 5-171433

[51] Int. Cl.[6] ..... G05F 3/24

[52] U.S. Cl. ..... 323/315; 327/541

[58] Field of Search ..... 327/65, 56, 54, 327/53, 546, 538, 537, 535, 333, 67, 66, 530, 539, 540, 541, 542, 543, 545, 538; 326/81, 80; 323/311, 313, 314, 315, 317, 312, 316

[56] References Cited

U.S. PATENT DOCUMENTS 4,520,282 5/1985 Watanabe et al. ..... 327/538
4,843,257 6/1989 Ohsawa ..... 327/65
5,077,518 12/1991 Han ..... 327/537
5,175,451 12/1992 Ihara ..... 327/67

FOREIGN PATENT DOCUMENTS 57-155628 9/1982 Japan ..... 323/313

*Primary Examiner*—Timothy P. Callahan
*Assistant Examiner*—Terry L. Englund
*Attorney, Agent, or Firm*—Armstrong, Westerman, Hattori, McLeland & Naughton

[57] ABSTRACT

A step-down circuit with a stabilized internal power supply in which the gate potential VG1 of an output transistor is controlled by the differential amplifying circuit so that the current flowing through the output transistor is increased/decreased when the internal power-supply potential is lowered/raised. The gate potential of the transistor which is varied as the variable current source of the differential amplifying circuit is controlled by the differential amplifying circuit so that the current flowing through the transistor is increased/decreased when the internal power-supply potential is lowered/raised in order to maintain a stabilized internal power supply.

10 Claims, 7 Drawing Sheets

STEP-DOWN CIRCUIT WITH STABILIZED INTERNAL POWER-SUPPLY

BACKGROUND OF THE INVENTION

1. Field of the Invention

The present invention relates to a step-down circuit that lowers a power-supply potential and controls the lowered potential at a constant internal power-supply potential and also to a semiconductor integrated circuit having this step-down circuit.

2. Description of the Related Art

As shown in FIG. 7, in recent semiconductor integrated circuits, reduction of power consumption and improved reliability of the devices are obtained by supplying a constant internal power-supply potential VII generated by lowering an outside power-supply potential VCC in a step-down circuit 20, to a internal circuit 30. The external power-supply potential VCC may be, for example, 5V and the internal power-supply potential VII may be 3.3 V above the ground potential.

The step-down circuit 20 is provided with a pMOS output transistor 21 which is connected between the external power-supply line SC and the internal power-supply line SI, a differential amplifying circuit 22 for controlling the gate potential VG1 of the output transistor 21 and a reference potential generating circuit 23 for supplying a reference potential VS to be used for comparison against the internal power-supply potential VII to the differential amplifying circuit 22. The differential amplifying circuit 22 is provided with nMOS transistors 41, 42, pMOS transistors 43, 44 and nMOS transistor 45. The nMOS transistor 45 functions as a constant current source with a constant potential VC applied to its gate.

As shown in the FIG. 7, the current that flows through a transistor j is generally designated as I, and the current that flows to the gate of the output transistor 21 as the internal power-supply potential VII fluctuates is designated as IG1, where the equations $$I45=I41+I42,$$

$$I43=I41+IG1,$$

are satisfied and also, since the pMOS transistors 43 and 44 constitute current mirror circuits, $$I43=IG1,$$

is satisfied.

When the internal power-supply potential VII is in a stable state, IG1=0, I43=I41, I41=I42, are satisfied.

If the internal power-supply potential VII is lowered from the stable state, the current I42 is decreased by Δ I and the current I41 is increased by Δ I. Therefore, IG1=−Δ A I and, as a result, the potential VG1 of the gate is lowered and the drain current of the output transistor 21 increases to raise the internal power-supply potential VII. In contrast, if the internal power-supply potential VII is raised from the stable state, the current I42 is increased by Δ I and the current I41 is decreased by Δ I. Therefore, IG1 =Δ I and, as a result, the gate potential VG1 is raised and the drain current of the output transistor 21 is decreased to lower the internal power-supply potential VII.

Because the output transistor 21 is required to supply power to the entire general circuit 30, a large driving ability is necessary with 9 gate width of several ten thousands of microns. Because of this, the gate of the output transistor 21 has a large parasitic capacitance and a large driving ability is required of the differential amplifying circuit 22 that controls the gate potential VG1. Since the driving ability of the differential amplifying circuit 22 is in proportion to the size of the current I45, it is necessary that the current I45 be at a large amount.

However, when the semiconductor integrated circuit 10 enters the standby state, the fluctuation of the internal power-supply potential VII becomes relatively small and in that state, therefore, a small driving ability will suffice for the differential amplifying circuit 22. As the current I45 is constant, when the semiconductor integrated circuit 10 is in the standby state, a waste current flows through the differential amplifying circuit 22 which causes the semiconductor integrated circuit 10 to consume excess power.

It may be considered that in order to solve this problem, a step-down circuit for the standby state is added so that separate circuits are provided for the standby state and the active state in such a way that the circuits are switched between each state according to the state of the semiconductor integrated circuit. However, the follow-up of the step-down circuit switching control to respond to the fluctuation of the internal power-supply potential VII is not sufficient, and results in fluctuation of the internal power-supply potential VII that exceeds the allowable value.

SUMMARY OF THE INVENTION

Accordingly, an object of the present invention is to provide a step-down circuit by which it is possible to maintain a stable internal power-supply potential in a semiconductor integrated circuit with low power consumption and also to provide a semiconductor integrated circuit that has this step-down circuit built in.

According to a first aspect of the invention, there is provided a step-down circuit that generates a second power-supply potential on a second power-supply line which is lower than a first power-supply potential on a first power-supply line and controls the second power-supply potential at a constant internal power supply potential, comprising: switch means disposed between the first power-supply line and the second power-supply line for controlling a current flowing through the switch; first control circuit for controlling the switch means based on the second power-supply potential a variable current source for providing a current with the switch control circuit; and a second control circuit for controlling the variable current source based on the second power-supply potential.

The step-down circuit structured as described above operates in the following manner:

The second power-supply potential is supplied to a general circuit and when the general circuit shifts from the stable standby state to the active state, current consumption of the general circuit increases significantly and the second power-supply potential VII is lowered as shown in FIG. 2 or FIG. 4, for example. The first control circuit responds to the lowering of this potential VII and increases the current that flows through the switch means while the second control circuit responds by increasing the current flowing through the variable current source. With this, the speed at which the first control circuit responds to the fluctuation of the second power-supply potential VII increases.

When the general circuit shifts from the active state to the stable standby state, current consumption of the general circuit decreases significantly and the second power-supply potential VII is raised. The first control circuit responds to the raising of this potential VII and decreases the current that flows through the switch means while the second control circuit responds by decreasing the current flowing through the variable current source I45. With this, the step-down circuit and a semiconductor integrated circuit that contains this step-down circuit can realize lower power consumption than those in the prior art.

According to a second aspect of the invention, there is provided a step-down circuit that generates a second power-supply potential on a second power-supply line by lowering a first power-supply potential on a first power-supply line and controls the second power-supply potential at a constant internal power-supply potential, comprising: an output transistor connected at its current input end to the first power-supply line and at its current output end to the second power-supply line, the output transistor having a control input for controlling current flowing from the current input end to the current output end by a control potential a reference potential generating circuit for generating a DC reference potential from its output end; a first differential amplifying circuit having: a first transistor connected at its control input end to the output end of the reference potential generating circuit; a second transistor connected at its control input end to the second power-supply line a variable current source through which sum of current flowing through the first transistor and the second transistor flows, the variable current source having a a control input for controlling the sum; and a first output end for outputting fluctuating component of the current flowing through the first transistor or the second transistor, the first output end being connected to the control input end of the output transistor so as to increase the current flowing through the output transistor when the second power-supply potential becomes low and reduce the current flowing through the output transistor when the second power-supply potential becomes high; and a second differential amplifying circuit having: a third transistor connected at its control input end to the output end of the reference potential generating circuit; a fourth transistor connected at its control input end to the second power-supply line; a constant current source through which sum of current flowing through the third transistor and the fourth transistor flows; and a second output end for outputting fluctuating component of the current flowing through the third transistor or the fourth transistor, the second output end being connected to the control input end of the variable current source so as to increase the current flowing through the variable current source when the second power-supply potential becomes low and reduce the current flowing through the variable current source when the second power-supply potential becomes high.

The transistors described above may be any of the following types: MIS type, MES type, bi-polar type or BiMIS type transistors.

The step-down circuit structured as described above operates in the following manner:

The second power-supply potential is supplied to a general circuit and when the general circuit shifts from the stable standby state to the active state, current consumption of the general circuit increases significantly and the second power-supply potential VII is lowered as shown in FIG. 2 or FIG. 4, for example. The first differential amplifying circuit responds to the lowering of this potential VII and increases the current that flows through the output transistor while the second differential amplifying circuit responds by increasing the current flowing through the variable current source. With this, the speed at which the first differential amplifying circuit responds to the fluctuation of the second power-supply potential VII improves.

When the difference between the current required by the general circuit and the current supplied to the general circuit decreases, the second power-supply potential VII increases. With this, the amount of change in the gate potential VG2 is decreased to reduce the current flowing through the variable current source. At the same time, the amount of change in the gate potential VG1 is reduced to decrease the current I21. Since the speed at which the second differential amplifying circuit responds to the fluctuation of the second power-supply potential VII is lowered with a reduction in the current I45, as the amount of change in the gate potential VG2 decreases, the amount of change in the gate potential VG1 also decreases, as shown in FIG. 2.

When the general circuit is in the active state, the current flowing through the variable current source is sufficiently small in comparison with the current for the whole of the general circuit, the driving ability of the variable current source can be quite small and still be sufficient in comparison with the driving ability of the output transistor. Because of this, the current flowing through the constant current source may be smaller than the current flowing through the variable current source. Also, in the standby state in which the current flowing to the output transistor is sufficiently small, the current flowing through the variable current source is controlled by the second differential amplifying circuit at a small amount. Consequently, the step-down circuit and a semiconductor integrated circuit that contains this step-down circuit can realize low power consumption compared with the prior art.

The above-described second aspect of the invention includes first to fourth forms as follows:

In the first form of the above-described second aspect of the invention, the first differential amplifying circuit comprises: the first transistor; the second transistor; the variable current source connected at its current input end to both the current output ends of the first and second transistors and at its output end to a third power-supply line supplied a potential lower than that of the second power-supply line; and a current mirror circuit having: a fifth transistor connected at its current input end to the first power-supply line and at its current output end to the current input end of the first transistor; and a sixth transistor connected at its current input end to the first power-supply line and at its current output end to the current input end of the second transistor, control input ends of the fifth and sixth transistor being connected such that currents flowing through the fifth and sixth transistors become equal to each other; the first output end being one of the current input ends of the first and second transistors.

In a second form of the above-described second aspect of the invention, the first differential amplifying circuit comprises: the first transistor; the second transistor; the variable current source connected at its current input end to the first power-supply line and at its output end to the current input ends of the first and second transistors; and a current mirror circuit having: a fifth transistor connected at its current input end to the current output end of the first transistor and at its current output end to a third power-supply line supplied a potential lower than that of the second power-supply line; and a sixth transistor connected at its current input end to the current output end of the second transistor and at its current output end to the third power-supply line; the first output end being one of the current output ends of the first and second transistors.

In a third form of the above-described second aspect of the invention, the second differential amplifying circuit comprises: the third transistor; the fourth transistor; the constant current source connected at its current input end to both the current output ends of the third and fourth transistors and at its output end to a third power-supply line supplied a potential lower than that of the second power-supply line; and a current mirror circuit having: a fifth transistor connected at its current input end to the first power-supply line and at its current output end to the current input end of the third transistor; and a sixth transistor connected at its current input end to the first power-supply line and at its current output end to the current input end of the fourth transistor, control input ends of the fifth and sixth transistor being connected such that currents flowing through the fifth and sixth transistors become equal to each other; the second output end being one of the current input ends of the third and fourth transistors.

In a fourth form of the above-described second aspect of the invention, the second differential amplifying circuit comprises: the third transistor; the fourth transistor; the constant current source connected at its current input end to the first power-supply line and at its output end to the current input ends of the third and fourth transistors; and a current mirror circuit having: a fifth transistor connected at its current input end to the current output end of the third transistor and at its current output end to a third power-supply line supplied a potential lower than that of the second power-supply line; and a sixth transistor connected at its current input end to the current output end of the fourth transistor and at its current output end to the third power-supply line; the second output end being one of the current output ends of the third and fourth transistors.

According to a third aspect of the invention, there is provided a semiconductor integrated circuit comprising: anyone of the above-described step-down circuit; and a general circuit operated by voltage between the second power-supply line and a third power-supply line supplied a potential lower than that of the second power-supply line.

DESCRIPTION OF THE PREFERRED EMBODIMENT

First Embodiment

Figure 1:
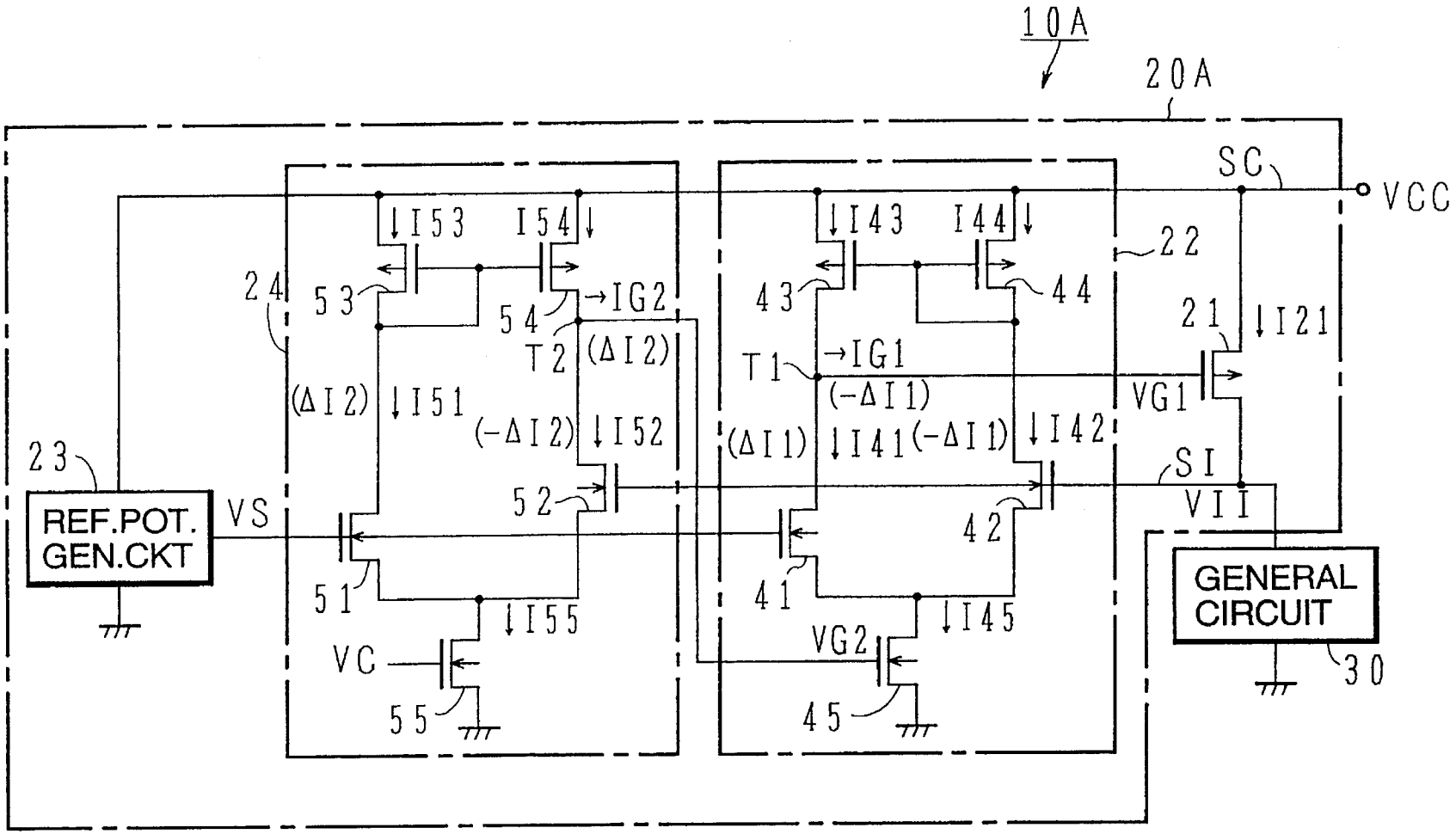
FIG. 1 is a diagram showing the semiconductor integrated circuit in the first embodiment according to the present invention.

FIG. 1 shows a semiconductor integrated circuit. 10A of the first embodiment.

This semiconductor integrated circuit 10A lowers the external power-supply potential VCC in the step-down circuit 20A to generate a constant internal power-supply potential VII. Low power consumption and improved reliability of the devices are realized by supplying the internal power-supply potential VII to the entirety of the general circuit 30.

The step-down circuit 20A is provided with a pMOS output transistor 21 connected between the external power-supply line SC and the internal power-supply line SI; the differential amplifying circuit 22 for controlling the gate potential VG1 of the output transistor 21; the differential amplifying circuit 24 for controlling the driving ability of the differential amplifying circuit 22 and the reference potential generating circuit 23 for supplying the reference potential VS for comparison against the internal power-supply potential VII to the differential amplifying circuits 22 and 24.

The differential amplifying circuit 22 is provided with the nMOS transistors 41, 42, the pMOS transistors 43, 44 and the nMOS transistor 45 as a variable current source. The nMOS transistor 41 is connected at its gate to the potential output end of the reference potential generating circuit 23 and at its drain as the output end of the circuit 22 both to the external power-supply line SC via the pMOS transistor 43 and the gate of the output transistor 21. The nMOS transistor 42 is connected at its gate to the drain of the output transistor 21 and at its drain to the external power-supply line SC via the pMOS transistor 44. The gates of the pMOS transistors 43 and 44 are commonly connected to the source of the pMOS transistor 44 to constitute a current mirror circuit. The sources of the nMOS transistors 41 and 42 are connected to the ground line via the nMOS transistor 45.

The differential amplifying circuit 24 is provided with the nMOS transistors 51, 52, the pMOS transistors 53, 54 and the nMOS transistor 55 and has an identical structure to that of the differential amplifying circuit 22. A constant potential VC is supplied to the gate of the nMOS transistor 55 by, for example, a current mirror circuit (not shown) so that the nMOS transistor 55 can function as a constant current source.

Between the differential amplifying circuits 24 and 22, the drain of the nMOS transistor 52, as the output end T2 of the circuit 24, is connected to the gate of the nMOS transistor 45 and the gates of the nMOS transistors 51 and 52 are connected to the gates of the nMOS transistors 41 and 42 respectively.

Next, the operation of the step-down circuit 20A structured as described above is explained.

As shown in the figure, the current that flows through a transistor j is designated as Ij generally and the currents that flow to the gates of the transistors 21 and 45 as the internal power-supply potential VII fluctuates are designated as IG1 and IG2 respectively, then, $$I45=I41+I42,$$

$$I43=I41+IG1,$$

$$I55=I51+I52,$$

$$I54=I52+IG2,$$

are satisfied. Also, as the pMOS transistors 43 and 44 constitute a current mirror circuit, and the pMOS transistors and 54 constitute a current mirror circuit, $$I43=I44,$$

$$I53=I54,$$

are satisfied.

When the internal power-supply potential VII is in the stable state, $$I_{G1}=0,\ I_{43}=I_{41},\ I_{41}=I_{42},$$

$$I_{G2}=0,\ I_{54}=I_{52},\ I_{51}=I_{52},$$

are satisfied.

Figure 2:
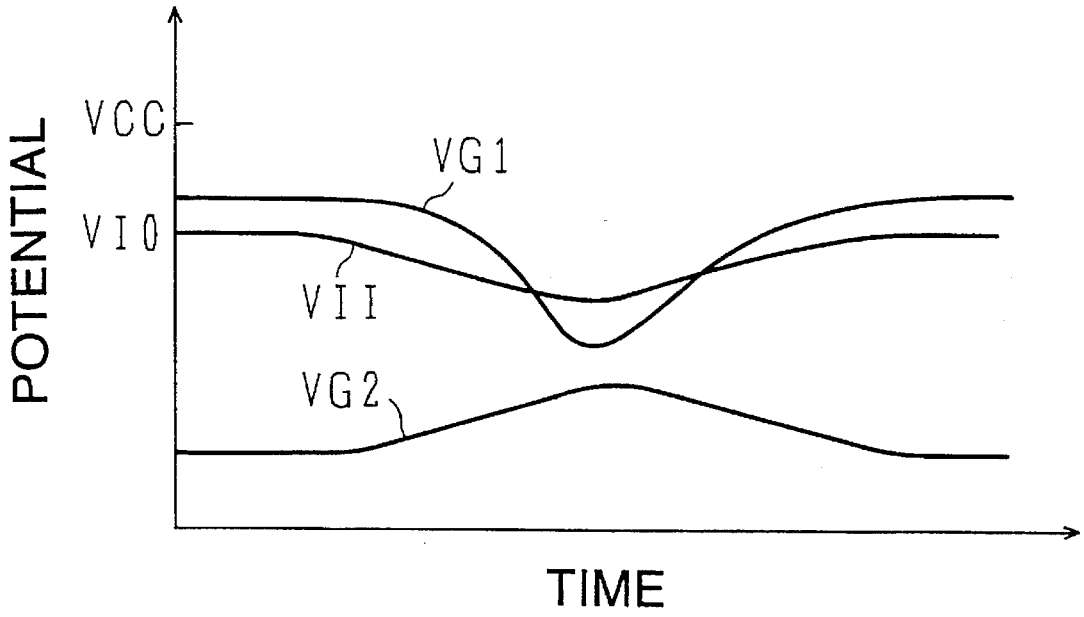
FIG. 2 is a chart showing changes in the potentials VII, VG1 and VG2 when the operation shifts from the standby state to the active state in the circuit shown in FIG. 1.

When the general circuit 30 shifts from the stable standby state to the active state, power consumption of the general circuit 30 increases greatly, and the internal power-supply potential VII is lowered as shown in FIG. 2. At this point, in the differential amplifying circuit 24, the current I52 is decreased by ΔI2 and the current I51 increases by ΔI2 so that $$I_{G2}=\Delta I_2,$$

and the gate potential VG2 increases to increase the current I45. On the other hand, in the differential amplifying circuit 22, the current I42 decreases by ΔI1 and the current I41 increases by ΔI1 so that $$I_{G1}=-\Delta I_1,$$

and, as a result, the gate potential VG1 is lowered to increase the current I21.

The internal power-supply potential VII is lowered while the difference between the current required by the general circuit 30 and the supplied current I21 to the general circuit 30 increases. As the gate potential VG2 increases, the current I45 increases and with this, the speed at which the internal differential amplifying circuit 22 responds to the fluctuation of the second power-supply potential VII improves, and the speed at which the gate potential VG1 is lowered also increases, as shown in FIG. 2.

As a result, even when the operation shifts from the standby state in which the current I45 is small, to the active state in which the current I45 is relatively large, the speed at which the differential amplifying circuit 22 performs control in response to the fluctuation of the internal power-supply potential VII is sufficiently high.

When the difference between the current required by the general circuit 30 and the current I21 supplied to the general circuit 30 decreases, the internal power-supply potential VII increases. With this, the value of IG2=ΔI2 is lowered and the gate potential VG2 is lowered to reduce the current I45. At the same time, the absolute value of IG1 =−ΔI1 is raised and the gate potential VG1 is raised to decrease the current I21. As the gate potential VG1 is lowered, the current I45 is decreased and with this, the speed at which the differential amplifying circuit 22 responds to fluctuation of the internal power-supply potential VII is reduced and the speed at which the gate potential VG1 increases slows down as shown in FIG. 2.

In this manner, feedback control is performed so that the internal power-supply potential VII is maintained at the constant value VI0. When the internal power-supply potential VII is raised from the stable value VI0, feedback control is performed in like manner described above so that the internal power-supply potential VII stays at the constant value VI0.

In the active state, since the current I45 is sufficiently small in comparison with the current I21 for the entirety of the general circuit 30, the driving ability of the nMOS transistor 45 can be quite smaller than that of the output transistor 21. Because of this, the constant current I55 may be smaller than the current I45 in the active state. Also, in the standby state in which the current I21 is sufficiently small, the current I45 is controlled by the differential amplifying circuit 24 at a small amount. Consequently, the step-down circuit 20A can realize low power consumption compared with the prior art.

Second Embodiment

Figure 3:
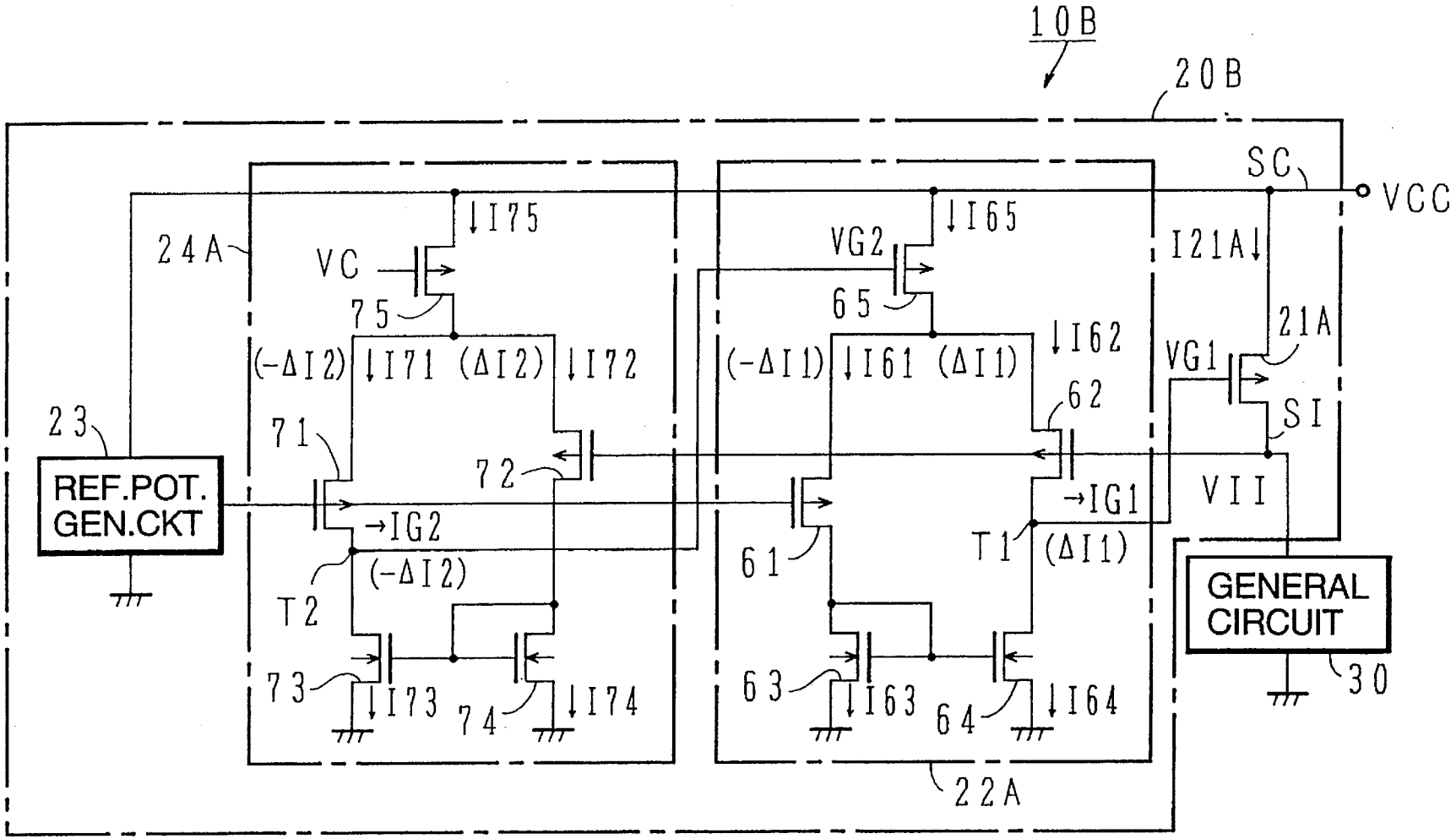
FIG. 3 is a diagram showing the semiconductor integrated circuit in the second embodiment according to the present invention.

FIG. 3 shows a semiconductor integrated circuit 10B in the second embodiment.

In the step-down circuit 20B of this semiconductor integrated circuit 10B, the differential amplifying circuits 22A and 24A are used instead of the differential amplifying circuits 22 and 24 shown in FIG. 1.

The differential amplifying circuit 22A is provided with the pMOS transistors 61, 62, the nMOS transistors 63, 64 and the pMOS transistor 65 as a variable current source. The pMOS transistor 61 is connected at its gate to the potential output end of the reference potential generating circuit 23 and at its drain to the ground line via the nMOS transistor 63. The pMOS transistor 62 is connected at its gate to the source of the output transistor 21A and at its drain as the output end T1 of the circuit 22A both to the ground via the nMOS transistor 64 and the gate of the nMOS transistor 21A. The gates of the nMOS transistors 63 and 64 are commonly connected to the drain of the nMOS transistor 63 to constitute a current mirror circuit. The sources of the pMOS transistors 61 and 62 are connected to the external power-supply line SC via the pMOS transistor 65.

The differential amplifying circuit 24A is provided with the pMOS transistors 71, 72, the nMOS transistors 73, 74 and the pMOS transistor 75 and has an identical structure to that of the differential amplifying circuit 22A. A constant potential VC is supplied to the gate of the pMOS transistor 75 by, for example, a current mirror circuit (not shown) so that the pMOS transistor 75 can function as a constant current source.

Between the differential amplifying circuit 24A and 22A, the drain of the pMOS transistor 71, as the output end T2 of the circuit 24A, is connected to the gate of the pMOS transistor 65.

Next, the operation of the step-down circuit 20B structured as described above is explained.

As for the current, like in the case illustrated in FIG. 1, the following equations, $$I_{65}=I_{61}+I_{62},$$

$$I_{64}=I_{62}+I_{G1},$$

$$I_{75}=I_{71}+I_{72},$$

$$I_{73}=I_{71}+I_{G2},$$

$$I_{63}=I_{64},\ I_{73}=I_{74},$$

are satisfied.

When the internal power-supply potential VII is in the stable state, $$I_{G1}=0,\ I_{63}=I_{64},\ I_{61}=I_{62},$$

$$I_{G2}=0,\ I_{73}=I_{71},\ I_{71}=I_{72},$$

are satisfied.

Figure 4:
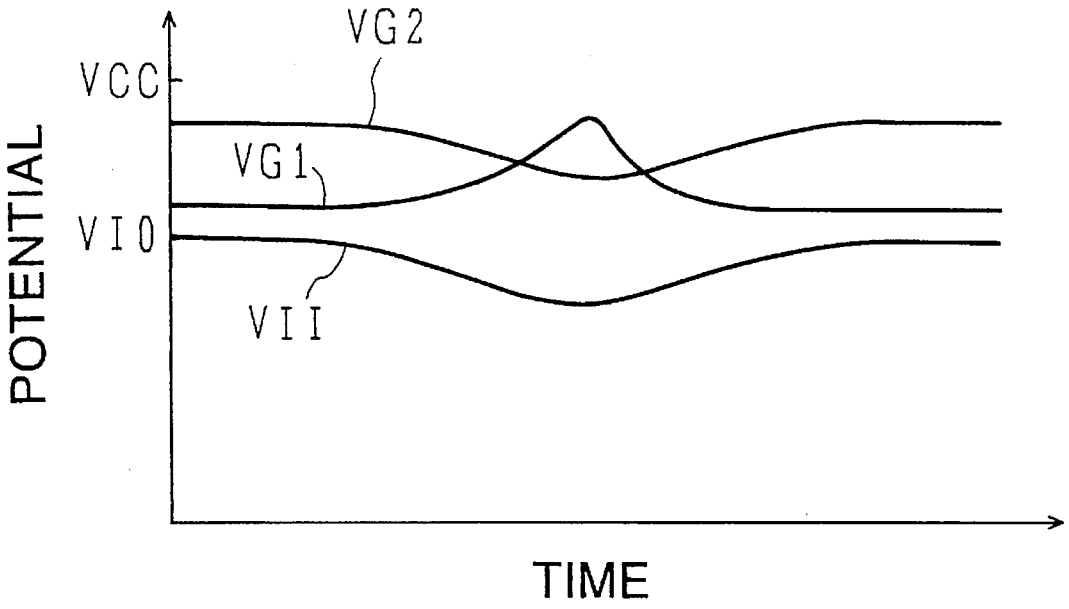
FIG. 4 is a chart showing changes in the potentials VII, VG1 and VG2 when the operation shifts from the standby state to the active state in the circuit shown in FIG. 3.

When the general circuit 30 shifts from the stable standby state to the active state, power consumption of the general circuit 30 increases greatly and the internal power-supply potential VII is lowered as shown in FIG. 4. At this, in the differential amplifying circuit 24A the current I72 is increased by ΔI2 and the current I71 decreases by ΔI2 so that, $$IG2=-I\ \Delta 2,$$

is satisfied and the gate potential VG2 is lowered to increase the current I65. At the same time, in the differential amplifying circuit 22A, the current I62 increases by ΔI1 and the current I61 decreases by ΔI1 so that, $$IG1=\Delta I1,$$

is satisfied and, as a result, the gate potential VG1 is increased to increase the current I21A. While the difference between the current required by the general circuit 30 and the current I21A increases, the internal power-supply potential VII decreases. Since the gate potential VG2 is decreased to improve the speed at which the step-down circuit 20B responds to the fluctuation of the internal power-supply potential VII, the speed at which the gate potential VG1 is raised increases as shown in FIG. 4.

All other operation can be easily understood from the explanation given for the first embodiment above and it is, therefore, omitted here.

The advantage of the second embodiment is identical to that of the first embodiment.

Third Embodiment

Figure 5:
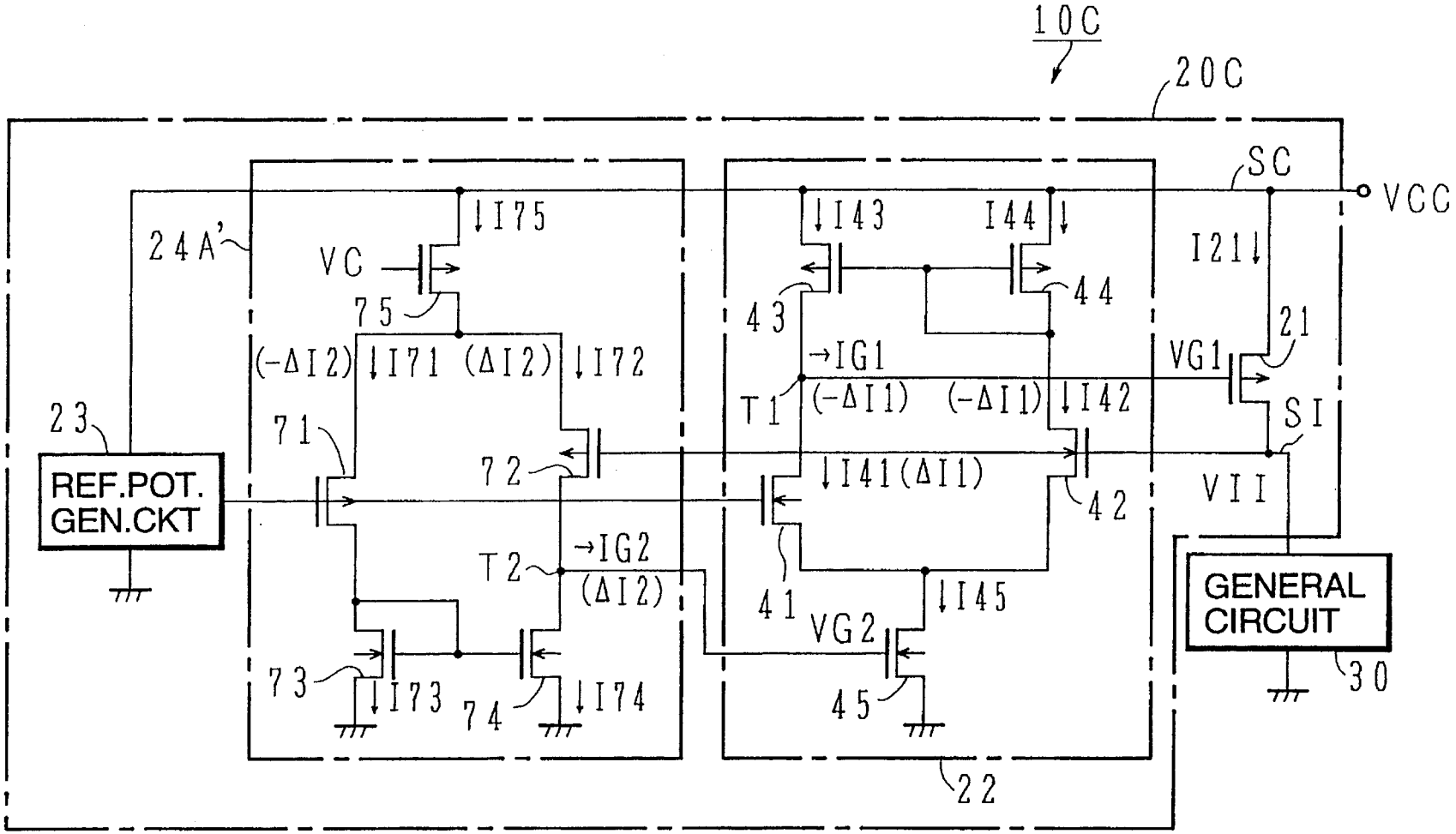
FIG. 5 is a diagram showing the semiconductor integrated circuit in the third embodiment according to the present invention.

FIG. 5 shows a semiconductor integrated circuit 10C in the third embodiment.

The step-down circuit 20C of this semiconductor integrated circuit 10C has a structure which is a combination of the first embodiment and the second embodiment described above. It employs the differential amplifying circuit 22 shown in FIG. 1 and a differential amplifying circuit 24A' which is similar to the differential amplifying circuit 24A shown in FIG. 3. The only difference in the differential amplifying circuit 24A' from the differential amplifying circuit 24A, is in the connection of the gate and drain of the pMOS transistor that constitutes the current mirror circuit.

Between the differential amplifying circuits 24A' and 22, the drain of the pMOS transistor 72, as the output end T2 of the circuit 24A', is connected to the gate of the nMOS transistor 45.

When the internal power-supply potential VII decreases from the stable state, the current I72 increases by ΔI2 and the current I71 decreases by ΔI2 so that IG2=ΔI2. As a result, the gate potential VG2 is raised to increase the current I45.

All other operation can be easily understood from the explanation given for the first and second embodiments above and it is, therefore, omitted here.

The advantage of the third embodiment is identical to that of the first embodiment.

Fourth Embodiment

Figure 6:
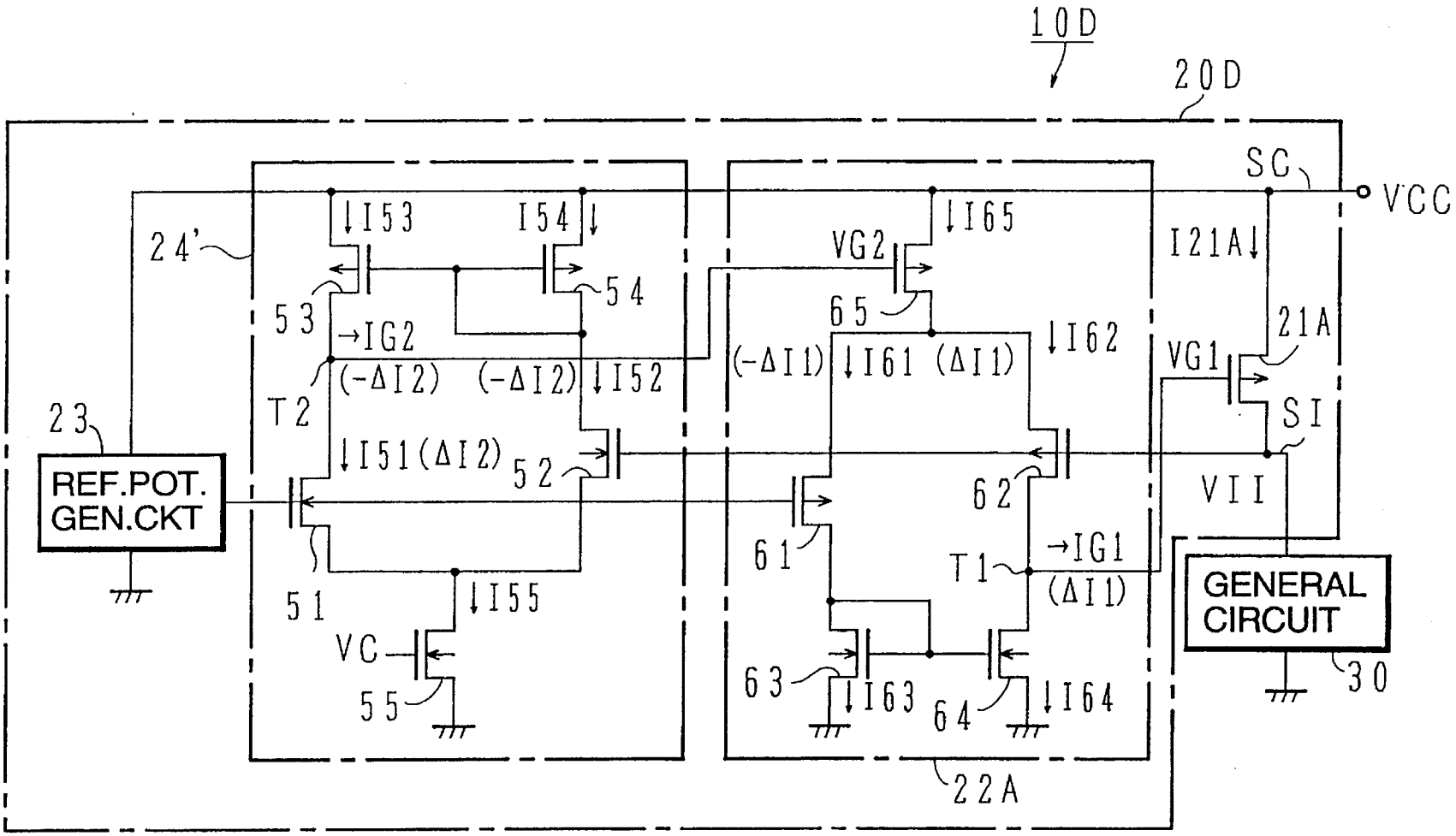
FIG. 6 is a diagram showing the semiconductor integrated circuit of the fourth embodiment according to the present invention.
Figure 7:
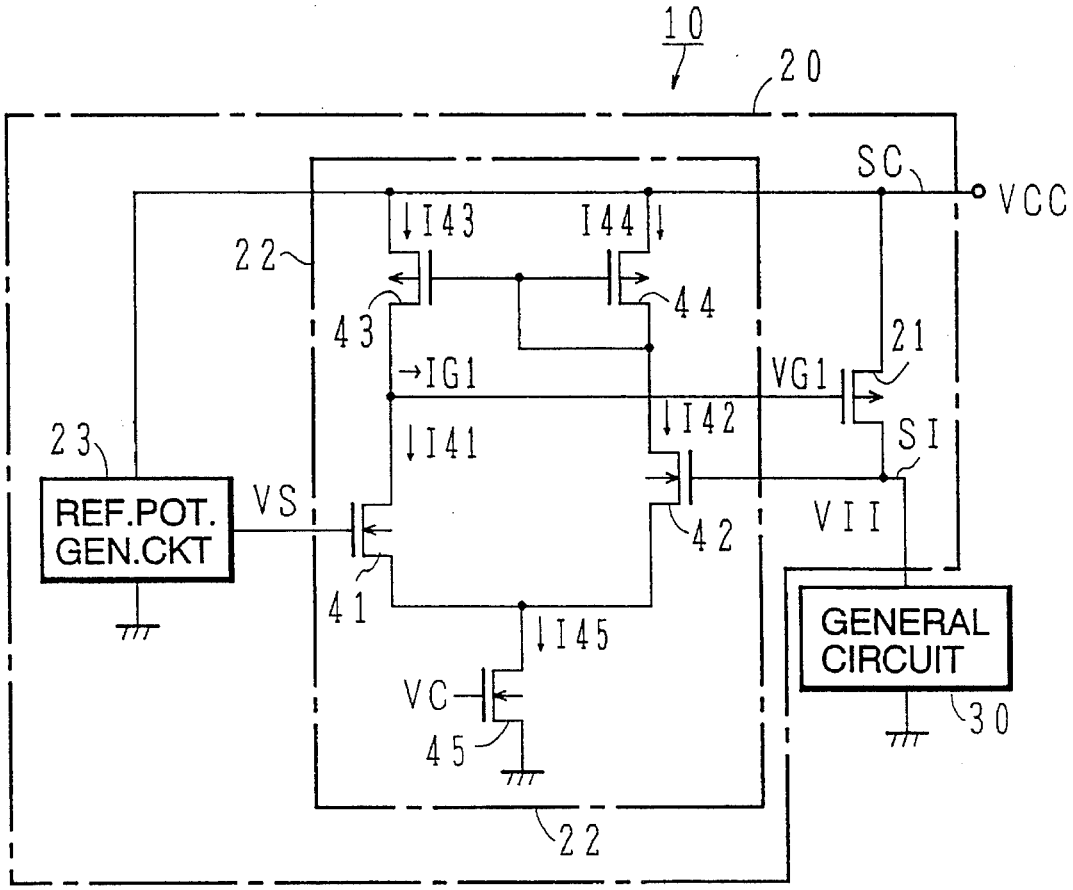
FIG.7 (PRIOR ART)
FIG. 7 is a diagram showing a semiconductor integrated circuit in the prior art.

FIG. 6 shows a semiconductor integrated circuit 10D in the fourth embodiment.

The step-down circuit 20D of this semiconductor integrated circuit 10D has a structure which is a combination of the first embodiment and the second embodiment described above. It employs the differential amplifying circuit 24' similar to the differential amplifying circuit 24 shown in FIG. 1 and the differential amplifying circuit 22A shown in FIG. 3. The only difference between the differential amplifying circuit 24' and the differential amplifying circuit 24, is in the connection of the gate and drain of the pMOS transistor that constitutes the current mirror circuit.

Between the differential amplifying circuits 24' and 22A, the drain of the nMOS transistor 51, as the output end T2 of the circuit 24', is connected to the gate of the pMOS transistor 65.

When the internal power-supply potential VII decreases from the stable state, the current I52 decreases by ΔI2 and the current I51 increases by ΔI2 so that IG2=−ΔI2. As a result, the gate potential VG2 decreases to increase the current I65.

All other operation can be easily understood from the explanation given for the first and second embodiments above and it is, therefore, omitted here.

The advantage of the fourth embodiment is identical to that of the first embodiment.

Having described specific embodiments of the present invention, it is to be understood that modification and variation of the invention are possible without departing from the spirit and scope thereof. For example, the transistors for the step-down circuit 20 are not limited to the MOS type and may be MES type, bipolar type or BiMOS type.

What is claimed is:

1. A step-down circuit that generates a second power-supply potential on a second power-supply line lower than a first power-supply potential on a first power-supply line and controls said second power-supply potential at a constant internal power-supply potential, comprising:

switch means disposed between the first power-supply line and the second power-supply line for controlling a current flowing through said switch means;

a first control circuit for controlling said switch means in response to the second power-supply potential;

a variable current source for providing a current through said first control circuit; and a second control circuit for controlling said variable current source in response to the second power-supply potential.

2. A step-down circuit that generates a second power-supply potential on a second power-supply line lower than a first power-supply potential on a first power-supply line and controls said second power-supply potential at a constant internal power-supply potential, comprising:

an output transistor connected between the first power-supply line and the second power-supply line, said output transistor having a control input for controlling current flowing therebetween;

a reference potential generating circuit for generating a DC reference potential at its output;

a first differential amplifying circuit comprising: a first transistor connected at its control input to said output of said reference potential generating circuit; a second transistor connected at its control input to said second power-supply line; a variable current source through which sum of current flowing through said first transistor and said second transistor flows, said variable current source having a control input for controlling said sum; and a first output for outputting fluctuating component of said current flowing through said first transistor or said second transistor, said first output being connected to said control input of said output transistor so as to increase said current flowing through said output transistor when said second power-supply potential becomes low and reduce said current flowing through said output transistor when said second power-supply potential becomes high; and a second differential amplifying circuit comprising: a third transistor connected at its control input to said output of said reference potential generating circuit; a fourth transistor connected at its control input to said second power-supply line; a constant current source through which sum of current flowing through said third transistor and said fourth transistor flows; and a second output for outputting fluctuating component of said current flowing through said third transistor or said fourth transistor, said second output being connected to said control input of said variable current source so as to increase said current flowing through said variable current source when said second power-supply potential becomes low and reduce said current flowing through said variable current source when said second power-supply potential becomes high.

3. A step-down circuit according to claim 2 wherein said first differential amplifying circuit comprises:

said first transistor;

said second transistor;

said variable current source connected at its current input to current outputs of both said first and second transistors and at its current output to a third power-supply line supplied a potential lower than that of said second power-supply line; and a current mirror circuit comprising: a fifth transistor connected at its current input to said first power-supply line and at its current output to a current input of said first transistor; and a sixth transistor connected at its current input to said first power-supply line and at its current output to a current input of said second transistor, control input of said fifth and sixth transistors being connected such that currents flowing through said fifth and sixth transistors become equal to each other;

said first output being one of said current input of said first and second transistors.

4. A step-down circuit according to claim 2 wherein said first differential amplifying circuit comprises:

said first transistor;

said second transistor;

said variable current source connected at its current input to said first power-supply line and at its output to current inputs of both said first and second transistors; and a current mirror circuit comprising: a fifth transistor connected at its current input to a current output of said first transistor and at its current output to a third power-supply line supplied a potential lower than that of said second power-supply line; and a sixth transistor connected at its current input to a current output end of said second transistor and at its current output to said third power-supply line, control inputs of said fifth and sixth transistors being connected such that currents flowing through said fifth and sixth transistors become equal to each other;

said first output being one of said current outputs of said first and second transistors.

5. A step-down circuit according to claim 2 wherein said second differential amplifying circuit comprises:

said third transistor;

said fourth transistor;

said constant current source connected at its current input to current outputs of both said third and fourth transistors and at its output to a third power-supply line supplied a potential lower than that of said second power-supply line; and a current mirror circuit comprising: a fifth transistor connected at its current input to said first power-supply line and at its current output to a current input of said third transistor; and a sixth transistor connected at its current input to said first power-supply line and at its current output to a current input of said fourth transistor, control inputs of said fifth and sixth transistors being connected such that currents flowing through said fifth and sixth transistors become equal to each other;

said second output being one of said current inputs of said third and fourth transistors.

6. A step-down circuit according to claim 3 wherein said second differential amplifying circuit comprises:

said third transistor;

said fourth transistor;

said constant current source connected at its current input to current outputs of both said third and fourth transistors and at its output to said third power-supply line; and a current mirror circuit comprising: a seventh transistor connected at its current input to said first power-supply line and at its current output to a current input of said third transistor; and an eighth transistor connected at its current input to said first power-supply line and at its current output to a current input of said fourth transistor, control inputs of said seventh and eighth transistors being connected such that currents flowing through said seventh and eighth transistors become equal to each other;

said second output being one of said current inputs of said third and fourth transistors.

7. A step-down circuit according to claim 4 wherein said second differential amplifying circuit comprises:

said third transistor;

said fourth transistor;

said constant current source connected at its current input to current outputs of both said third and fourth transistors and at its output to said third power-supply line; and a current mirror circuit comprising: a seventh transistor connected at its current input to said first power-supply line and at its current output to a current input of said third transistor; and an eighth transistor connected at its current input to said first power-supply line and at its current output to a current input of said fourth transistor, control inputs of said seventh and eighth transistors being connected such that currents flowing through said seventh and eighth transistors become equal to each other;

said second output being one of said current inputs of said third and fourth transistors.

8. A step-down circuit according to claim 2 wherein said second differential amplifying circuit comprises:

said third transistor;

said fourth transistor;

said constant current source connected at its current input to said first power-supply line and at its output to current inputs of both said third and fourth transistors; and a current mirror circuit comprising: a fifth transistor connected at its current input to a current output of said third transistor and at its current output to a third power-supply line supplied at a potential lower than that of said second power-supply line; and a sixth transistor connected at its current input to a current output of said fourth transistor and at its current output to said third power-supply line, control inputs of said fifth and sixth transistors being connected such that currents flowing through said fifth and sixth transistors become equal to each other;

said second output being one of said current outputs of said third and fourth transistors.

9. A step-down circuit according to claim 3 wherein said second differential amplifying circuit comprises:

said third transistor;

said fourth transistor;

said constant current source connected at its current input to said first power-supply line and at its output to current inputs of both said third and fourth transistors; and a current mirror circuit comprising: a seventh transistor connected at its current input to a current output of said third transistor and at its current output to said third power-supply line; and an eighth transistor connected at its current input to a current output of said fourth transistor and at its current output to said third power-supply line, control inputs of said seventh and eight transistors being connected such that currents flowing through said seventh and eighth transistors become equal to each other;

said second output being one of said current outputs of said third and fourth transistors.

10. A step-down circuit according to claim 4 wherein said second differential amplifying circuit comprises:

said third transistor;

said fourth transistor;

said constant current source connected at its current input to said first power-supply line and at its output to current inputs of both said third and fourth transistors; and a current mirror circuit comprising: a seventh transistor connected at its current input to a current output of said third transistor and at its current output to said third power-supply line; and an eighth transistor connected at its current input to a current output of said fourth transistor and at its current output to said third power-supply line, control inputs of said seventh and eighth transistors being connected such that currents flowing through said seventh and eighth transistors become equal to each other;

said second output being one of said current outputs of said third and fourth transistors.

* * * * *